US010633974B2

(12) United States Patent
Sekularac

(10) Patent No.: US 10,633,974 B2
(45) Date of Patent: Apr. 28, 2020

(54) COMPRESSOR WHEEL OF THE COMPRESSOR OF AN EXHAUST-GAS TURBOCHARGER

(71) Applicant: BorgWarner Inc., Auburn Hills, MI (US)

(72) Inventor: Aleksandar Sekularac, Worms (DE)

(73) Assignee: BorgWarner Inc., Auburn Hills, MI (US)

( * ) Notice: Subject to any disclaimer, the term of this patent is extended or adjusted under 35 U.S.C. 154(b) by 591 days.

(21) Appl. No.: 14/420,070

(22) PCT Filed: Jul. 31, 2013

(86) PCT No.: PCT/US2013/052864
§ 371 (c)(1),
(2) Date: Feb. 6, 2015

(87) PCT Pub. No.: WO2014/028214
PCT Pub. Date: Feb. 20, 2014

(65) Prior Publication Data

US 2015/0204278 A1 Jul. 23, 2015

(30) Foreign Application Priority Data

Aug. 13, 2012 (DE) ..... 10 2012 016 028

(51) Int. Cl.
*F01D 5/14* (2006.01)
*F02M 26/07* (2016.01)
(Continued)

(52) U.S. Cl.
CPC ..... *F01D 5/14* (2013.01); *F01D 5/146* (2013.01); *F02M 26/07* (2016.02);
(Continued)

(58) Field of Classification Search
None
See application file for complete search history.

(56) References Cited

U.S. PATENT DOCUMENTS 2,399,852 A * 5/1946 Campbell ..... F01D 5/045 415/143
2,422,615 A * 6/1947 Halford ..... F04D 29/284 416/188

(Continued)

FOREIGN PATENT DOCUMENTS

KR 20120036932 A 4/2012

OTHER PUBLICATIONS

International Search Report and Written Opinion in International Application No. PCT/US2013/052864 dated Nov. 21, 2013.

*Primary Examiner* — Umashankar Venkatesan
(74) *Attorney, Agent, or Firm* — Eric L. Doyle; Stephan A. Pendorf; Patent Central LLC

(57) ABSTRACT

A compressor wheel (1) of a compressor (6A) of an exhaust-gas turbocharger (6), having a hub (2); and having a multiplicity of non-recessed blades (3) which are arranged on the hub (2) and which have in each case a blade leading edge (3A) and a blade trailing edge (3B). The blade leading edges (3A) define an inlet area ($A_1$) which is the area swept by the blade leading edges (3A) as the compressor wheel (1) rotates. The blade trailing edges (3B) define an outlet area ($A_2$) which is the area swept by the blade trailing edges (3B) as the compressor wheel (1) rotates. The ratio $A_2/A_1$ is >60%.

5 Claims, 1 Drawing Sheet

(51) Int. Cl.

| | |
|---|---|
| ***F04D 29/28*** | (2006.01) |
| *F02B 37/00* | (2006.01) |
| *F02B 37/013* | (2006.01) |

(52) U.S. Cl.

CPC ..... *F04D 29/284* (2013.01); *F02B 37/004* (2013.01); *F02B 37/013* (2013.01); *F05D 2220/40* (2013.01)

(56) References Cited

U.S. PATENT DOCUMENTS

| | | | | |
|---|---|---|---|---|
| 2,484,554 | A * | 10/1949 | Concordia | F04D 29/30 415/203 |
| 7,937,942 | B2 | 5/2011 | Gobert et al. | |
| 2007/0128018 | A1 | 6/2007 | Sumser et al. | |
| 2009/0266060 | A1 * | 10/2009 | Guo | F02D 41/029 60/295 |
| 2011/0020152 | A1 | 1/2011 | Ising | |
| 2012/0124994 | A1 | 5/2012 | Hommes et al. | |

* cited by examiner

COMPRESSOR WHEEL OF THE COMPRESSOR OF AN EXHAUST-GAS TURBOCHARGER

The invention relates to a compressor wheel of the compressor of an exhaust-gas turbocharger, as per the preamble of claim 1.

A so-called two-stage supercharger device for internal combustion engines comprises two turbochargers of different size which are connected in series. Here, the smaller turbocharger is the high-pressure exhaust-gas turbocharger, whereas the larger exhaust-gas turbocharger is the low-pressure exhaust-gas turbocharger.

This type of two-stage supercharging has the advantage that the two separate compressor stages must in each case generate only a part of the overall pressure increase of the overall system.

It is an object of the present invention to provide a compressor wheel of a compressor of an exhaust-gas turbocharger, the compressor wheel geometry of which is optimized.

This object is achieved by the features of claim 1.

By virtue of the fact that the ratio between the inlet area and the outlet area of the compressor wheel according to the invention is set to values greater than 60%, particularly advantageous effects are attained for usage with the two-stage supercharging systems explained above. The use of the compressor wheel according to the invention is however not restricted to two-stage supercharging systems, because a lower compressor pressure ratio can be used also in single-stage systems.

Claim 3 defines an exhaust-gas turbocharger according to the invention as an independent marketable product.

Further details, advantages and features of the present invention become apparent from the following description of exemplary embodiments with reference to the drawing, in which.

Figure 1:
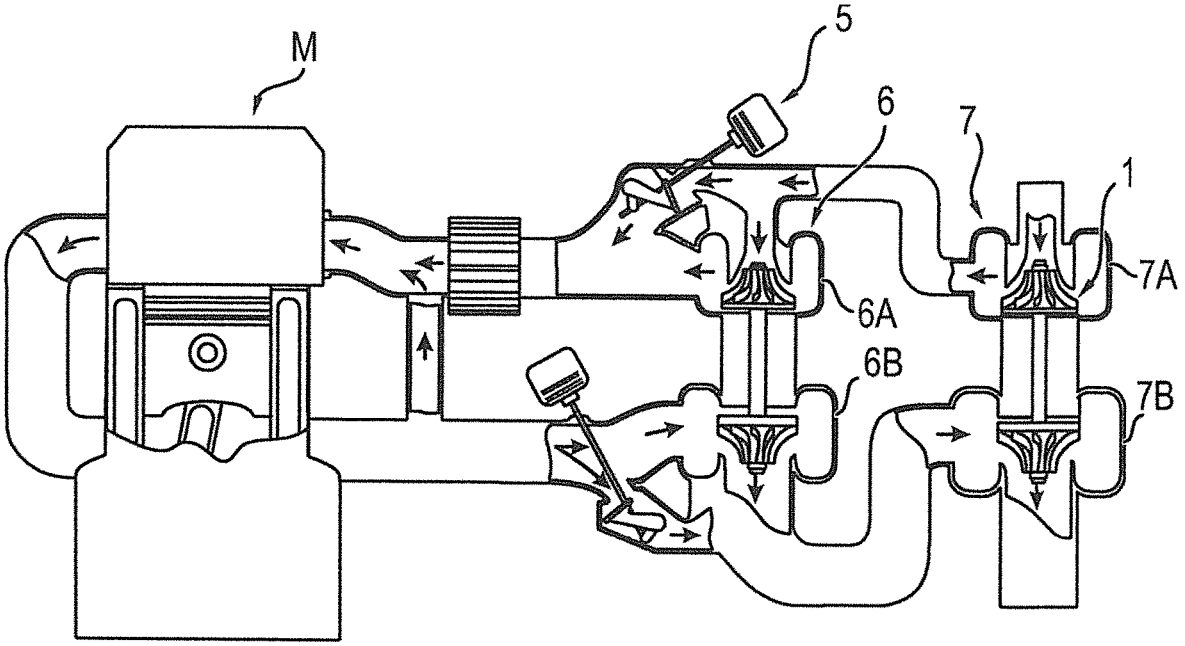
FIG. 1 is a schematic illustration of a two-stage supercharging system.

FIG. 1 is a schematic illustration of a two-stage supercharging device 5 for an engine M, which is indicated symbolically by one of the cylinders thereof. The two-stage supercharging device 5 has two exhaust-gas turbochargers 6 and 7 connected in series. The turbocharger 6 constitutes the high-pressure exhaust-gas turbocharger with associated compressor 6A and associated turbine 6B.

The exhaust-gas turbocharger 6 is the high-pressure exhaust-gas turbocharger with associated compressor 6A and associated turbine 6B. The compressor wheel 1 according to the invention is, by way of example, the compressor wheel of the described high-pressure compressor 6A, and will be explained in detail below on the basis of FIG. 2.

The compressor wheel 1 has a hub 2. On the hub 2 there is arranged a multiplicity of non-recessed blades, of which one blade is indicated, representatively for all of the blades, by the reference numeral 3. In the example, six such blades 3 are provided. Between the non-recessed blades 3 there are arranged recessed blades 4, also referred to as "splitter blades".

Figure 2:
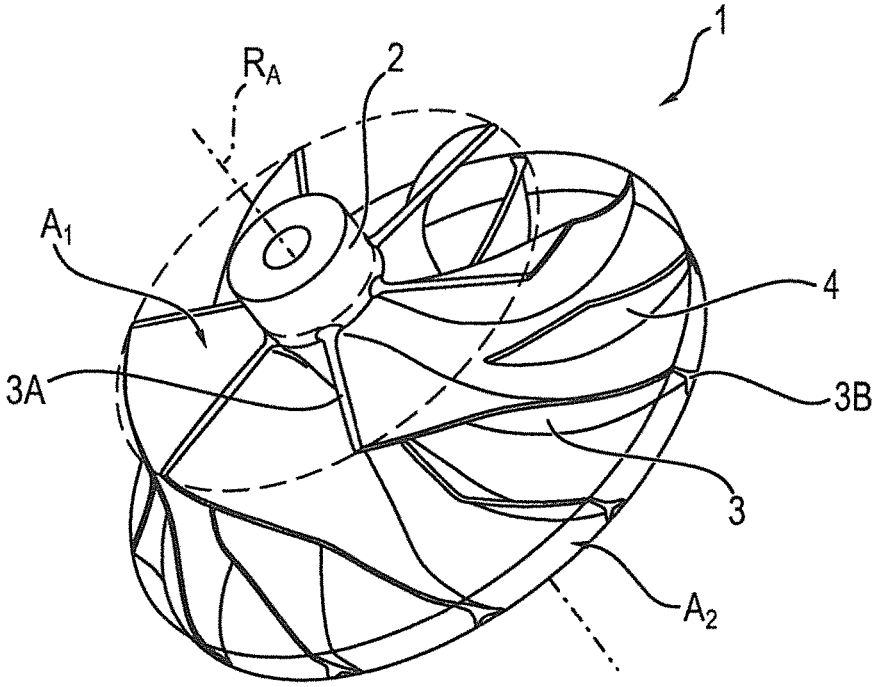
FIG. 2 is a perspective illustration of a compressor wheel according to the invention.

FIG. 2 shows that the blades 3 have in each case a leading edge 3A and a trailing edge 3B. Here, the blade leading edges 3A define an inlet area $A_1$ which is the area swept by the blade leading edges 3A as the compressor wheel 1 rotates. As shown in FIG. 2, said inlet area $A_1$ is perpendicular to the axis of rotation $R_A$.

The blade trailing edges 3B of the non-recessed blades 3 define an outlet area A2 which is the area swept by the blade trailing edges 3B as the compressor wheel 1 rotates. This yields, as shown in FIG. 2, a cylindrical surface which, as per the above definitions, constitutes the "normalized" blade height at the outlet of the compressor wheel 1, which can also be referred to as the "tip height" and which is independent of the compressor wheel size and configuration.

According to the invention, the ratio $A_2/A_1$ is configured to values of >60%.

In addition to the above written disclosure of the invention, reference is hereby explicitly made to the diagrammatic illustration of the invention in FIGS. 1 and 2 for additional disclosure thereof.

LIST OF REFERENCE SIGNS

1 Compressor wheel
2 Hub
3 Non-recessed blades
4 Recessed blades
5 Two-stage supercharging device
6 High-pressure exhaust-gas turbocharger
6A High-pressure compressor
6B High-pressure turbine
7 Low-pressure exhaust-gas turbocharger
7A Low-pressure compressor
7B Low-pressure turbine
$A_1$ Inlet area
$A_2$ Outlet area
$R_A$ Axis of rotation
M Engine

The invention claimed is:

1. A two-stage supercharging device comprising a high pressure exhaust gas turbocharger and a low pressure exhaust gas turbocharger connected in series, each turbocharger comprising a compressor (6A, 7A), each compressor (6A, 7A) comprising a compressor wheel (1), at least one of said compressor wheels (1), having a hub (2); and a multiplicity of non-recessed blades (3) which are arranged on the hub (2) and which have in each case a blade leading edge (3A) and a blade trailing edge (3B), wherein the blade leading edges (3A) define an inlet area ($A_1$) which is the area swept by the blade leading edges (3A) as the compressor wheel (1) rotates, the blade trailing edges (3B) define an outlet area ($A_2$) which is the area swept by the blade trailing edges (3B) as the compressor wheel (1) rotates, and the ratio $A_2/A_1$ is >60%.

2. The two-stage supercharging device as claimed in claim 1, wherein the compressor wheel is the compressor wheel of the high-pressure exhaust-gas turbocharger (6) of the two-stage supercharging device (5).

3. The two-stage supercharging device as claimed in claim 1, wherein the compressor wheel is the compressor wheel of the low-pressure exhaust-gas turbocharger (7) of the two-stage supercharging device (5).

4. The two-stage supercharging device as claimed in claim 1, wherein the compressor wheel of the high-pressure exhaust-gas turbocharger (6) and the compressor wheel of the low-pressure exhaust-gas turbocharger (7) have a hub (2); and a multiplicity of non-recessed blades (3) which are arranged on the hub (2) and which have in each case a blade leading edge (3A) and a blade trailing edge (3B), wherein the blade leading edges (3A) define an inlet area ($A_1$) which is the area swept by the blade leading edges (3A) as the compressor wheel (1) rotates, and wherein the blade trailing edges (3B) define an outlet area ($A_2$) which is the area swept by the blade trailing edges (3B) as the compressor wheel (1) rotates, wherein the ratio $A_2/A_1$ is >60%.

5. The two-stage supercharging device as claimed in claim 1, wherein the compressor (6A) of the high-pressure exhaust-gas turbocharger (6) is provided with a compressor bypass (5) and the turbine (6B) of the high-pressure exhaust-gas turbocharger (6) is provided with a turbine bypass.

* * * * *